US008505375B2

(12) United States Patent
Smalley

(10) Patent No.: US 8,505,375 B2
(45) Date of Patent: Aug. 13, 2013

(54) GEOCHEMICAL SURVEILLANCE OF GAS PRODUCTION FROM TIGHT GAS FIELDS

(75) Inventor: Philip Craig Smalley, Surrey (GB)

(73) Assignee: BP Exploration Operating Company Limited, Middlesex (GB)

( * ) Notice: Subject to any disclaimer, the term of this patent is extended or adjusted under 35 U.S.C. 154(b) by 462 days.

(21) Appl. No.: 12/736,425

(22) PCT Filed: Mar. 13, 2009

(86) PCT No.: PCT/GB2009/000683
§ 371 (c)(1),
(2), (4) Date: Oct. 7, 2010

(87) PCT Pub. No.: WO2009/125161
PCT Pub. Date: Oct. 15, 2009

(65) Prior Publication Data

US 2011/0030465 A1 Feb. 10, 2011

(30) Foreign Application Priority Data

Apr. 9, 2008 (EP) ..... 08251372

(51) Int. Cl.
*E21B 49/00* (2006.01)

(52) U.S. Cl.
USPC ..... 73/152.08

(58) Field of Classification Search
USPC ..... 73/152.02, 152.08, 152.09, 152.11
See application file for complete search history.

(56) References Cited

U.S. PATENT DOCUMENTS

| | | | | |
|---|---|---|---|---|
| 3,446,597 | A | 5/1969 | Bray et al. | |
| 5,388,456 | A | 2/1995 | Kettel | |
| 7,346,457 | B2 * | 3/2008 | Jalali et al. | 702/12 |
| 8,061,444 | B2 * | 11/2011 | Mullins et al. | 175/50 |
| 2007/0225916 | A1 * | 9/2007 | Jalali et al. | 702/6 |
| 2008/0157584 | A1 * | 7/2008 | Kieschnick | 299/2 |
| 2009/0288881 | A1 * | 11/2009 | Mullins et al. | 175/50 |
| 2011/0088895 | A1 * | 4/2011 | Pop et al. | 166/254.2 |
| 2012/0312530 | A1 * | 12/2012 | Pope et al. | 166/250.01 |

FOREIGN PATENT DOCUMENTS

| | | |
|---|---|---|
| CA | 1 320 007 | 7/1993 |
| DE | 196 21 158 | 9/1997 |
| RU | 2 265 715 | 12/2005 |

OTHER PUBLICATIONS

International Search Report for PCT/GB2009/000683, mailed Aug. 18, 2009.

Written Opinion of the International Searching Authority for PCT/GB2009/000683, mailed Aug. 18, 2009.

(Continued)

*Primary Examiner* — John Fitzgerald
(74) *Attorney, Agent, or Firm* — Nixon & Vanderhye

(57) ABSTRACT

Method of estimating the recovery factor for the volume drained by at least one producing gas well that penetrates a tight gas reservoir or a coal bed methane reservoir, by (a) calibrating changes in the isotopic composition of at least one component of the gas that is produced from the gas well with increasing recovery factor, (b) obtaining a sample of produced gas from the producing gas well and analyzing the sample to obtain the isotopic composition of the component of the produced gas and (c) using the calibration obtained in step (a) and the isotopic composition determined in step (b) to estimate the recovery factor for the volume drained by the gas well. The estimate of the recovery factor determined in step (c) and the cumulative volume of gas produced from the gas well is used to determine the volume drained by the gas well.

10 Claims, 3 Drawing Sheets

(56) References Cited

OTHER PUBLICATIONS

Strapoc et al., "Carbon Isotopic Fractionation of CH4 and CO2 During Canister Desporation of Coal", Organic Geochemistry, Pergamon, vol. 37, No. 2, Feb. 1, 2006, pp. 152-164, XP005271123.

Alexeev et al."Methane Desorption from a Coal-bed", Fuel, IPC Science and Technology Press, Guildford, GB, vol. 86, No. 16, Oct. 9, 2007, pp. 2574-2580, XP022293304.

* cited by examiner

GEOCHEMICAL SURVEILLANCE OF GAS PRODUCTION FROM TIGHT GAS FIELDS

This application is the U.S. national phase of International Application No. PCT/GB2009/000683, filed 13 Mar. 2009, which designated the U.S. and claims priority to European Application No. 08251372.2, filed 9 Apr. 2008, the entire contents of each of which are hereby incorporated by reference.

The present invention relates to a surveillance technique that provides an estimate of the fraction of natural gas that has been produced from tight gas reservoirs, tight shale gas reservoirs or coalbed methane reservoirs (referred to as "recovery factor") by analyzing the isotopic composition of the recovered gas and correlating this isotopic composition with the recovery factor. The present invention also provides an estimation of the volume drained by a gas well that penetrates a tight gas reservoir, tight shale gas reservoir or coalbed methane reservoir.

BACKGROUND OF THE INVENTION

In conventional gas fields, where the gas is held volumetrically in the pores of the reservoir and where the gas can flow relatively easily to the producing wells, production can be monitored using pressure-volume relationships. As gas is produced, the pressure reduces concomitantly with the reduction in remaining gas volume, and flow rate reduces concomitantly with decreasing pressure. A typical plot of P/Z against cumulative gas production (where P is the reservoir pressure and Z is the gas compressibility factor) allows production data to be interpreted in terms of the amount of gas that is in contact with the producing well (i.e. the amount of gas being drained by the producing well), how much of the gas has been produced to date, and (assuming pressure cut-offs) an estimate of how much gas will be produced ultimately. Any decision to drill an infill gas well can usually be based on a reasonable prediction of the likely remaining gas volume to be accessed by the infill well.

Natural gas may be found associated with coal in a coalbed methane (CBM) reservoir. In such CBM reservoirs, the gas is not stored in pore spaces but is adsorbed onto the structure of the coal. Production is initiated by reducing the pressure (initially by pumping water from the CBM reservoir), so that the natural gas (predominantly methane) begins to desorb from the coal and to move, initially through micropores in the coal, towards a producing gas well. The pressure-volume-rate relationships from a producing gas well of a CBM reservoir are therefore very different to those from a conventional gas well. In particular, gas flow rate from a producing gas well of a CBM reservoir may increase as pressure decreases, and may continue at a steady rate or even at an increasing rate for years before finally declining.

A similar situation arises in tight gas reservoirs, for example, tight gas sands and tight shale gas reservoirs wherein the term "tight" means that the natural gas is contained within a very low permeability reservoir rock from which natural gas production is difficult. Typically, the rock of a tight gas reservoir has an effective permeability of less than 1 millidarcy. The tighter the rock (i.e. the lower its permeability), the greater the effect that the rock matrix has on holding the gas, and the more tortuous the network of fine pores through which the gas must flow before it can be produced. Accordingly, it is difficult to estimate the contacted volume (i.e. the volume of the reservoir that is being drained by a gas well) and recovery factor using gas production data from tight gas reservoirs.

Studies of tight gas reservoirs that have producing gas wells at different spacings show that closer infill spacings give progressively smaller incremental gas recoveries. This is because the infill locations have been partially depleted owing to production from existing wells. Such studies based on analogue data (obtained from analogous tight gas reservoirs having similar rock matrix, reservoir pressure etc.) can estimate, on average, the value of infill wells for a tight gas reservoir, but it is much more difficult to estimate the recoverable volume for a specific infill well location and hence the value of the infill well location.

SUMMARY OF THE INVENTION

The problem addressed by the present invention is that in CBM and tight gas reservoirs it is difficult to interpret gas production data in terms of a drainage volume and recovery factor. The "drainage volume" of a producing gas well is defined as the reservoir volume (area and thickness) drained by the well. When several wells drain the same tight gas reservoir or CBM reservoir, each well drains its own drainage volume which is a subset of the reservoir volume. "Recovery factor" is defined as the fraction of gas produced from the drainage volume of a producing gas well compared to the amount of gas originally in place within the drainage volume. When assessing the value of an infill well, it is necessary to estimate the drainage volume for each of the surrounding existing producing wells and the recovery factor for that drainage volume, in order to determine whether the reservoir volume at the infill location has already been drained by one or more of the existing producing wells. However, with tight gas reservoirs, it is generally not possible to determine whether, having produced a given volume of gas from the existing wells, this represents a low recovery factor over a large drainage area, or a higher recovery factor over a smaller drainage area. This distinction is critically important for prioritizing infill well locations.

It is known that the natural gas produced from a tight gas reservoir or from a coalbed methane reservoir is comprised of various isotopic forms of methane ($CH_4$) and various isotopic forms of other hydrocarbon components of the natural gas such as ethane ($C_2H_6$), propane ($C_3H_8$), butane ($C_4H_{10}$), and pentane ($C_5H_{12}$). Thus, carbon has two main stable isotopes ($^{12}C$ and $^{13}C$) while hydrogen has two stable isotopes ($^{1}H$ and $^{2}H$ (also referred to as deuterium, D)). Accordingly, methane exists in a variety of isotopic forms: $^{12}CH_4$, $^{12}CH_3D$, $^{12}CH_2D_2$, $^{12}CHD_3$, $^{12}CD_4$, $^{13}CH_4$, $^{13}CH_3D$, $^{13}CH_2D_2$, $^{13}CHD_3$, and $^{13}CD_4$). It is also known that natural gas accumulations may contain, in addition to hydrocarbon gases, other gases such as carbon dioxide ($CO_2$), nitrogen, and noble gases such as helium, neon and argon. It is also known that all of these additional gases exist in different isotopic forms. Thus, there are two stable isotopic forms of nitrogen ($^{15}N/^{14}N$) two stable isotopic forms of helium ($^{3}He/^{4}He$), three stable isotopes of neon ($^{20}Ne/^{21}Ne/^{22}Ne$) and three stable isotopes of Argon ($^{36}Ar/^{38}Ar/^{40}Ar$).

The natural variation of the $^{12}C$ isotope in nature is generally in the range of 0.98853-0.99037 (mole fraction) while the natural variation of the $^{13}C$ isotope in nature is generally in the range of 0.00963-0.01147 (mole fraction). Generally $^{1}H$ (hydrogen) has an abundance in nature of greater than 99.98% while $^{2}H$ (deuterium, D) comprises 0.0026-0.0184% by mole fraction of hydrogen samples on earth. The isotopic ratios $^{13}C/^{12}C$ and $^{2}H/^{1}H$ (D/H) are usually expressed as a delta notation ($\delta^{13}C$, $\delta^{2}H$ (or $\delta D$)), representing parts per thousand (%) variation from an international standard composition. The international standard composition is usually the Pee Dee Belemnite (PDB) standard composition for carbon and the Standard Mean Ocean Water (SMOW) composition for hydrogen.

It is known that the different isotopic forms of methane may fractionate during various natural and induced processes. Thus, it has been reported that the different isotopic forms of methane may fractionate during evaporation, or during gas generation from the maturation of kerogen (Whiticar, M. J. (1996) "Stable isotope geochemistry of coals, humic kerogens and related natural gases", International Journal of Coal Geology 32, 191-215). It has also been reported that the $\delta^{13}C$ of methane produced from coal beds in the San Juan basin is in the range −42 to −48‰ while δD is in the range of −200 to −250‰ (Zhou, Z, Ballentine, C. J., Kipfer, R, Schoell, M & Thibodeaux, S. (2005) "Noble gas tracing of groundwater/coalbed methane interaction in the San Juan Basin, USA", Geochimica et Cosmochimica Acta 69, 5413-5428). Analytical precision has been reported to be in the region of 0.1‰ for $\delta^{13}C$ and 1‰ for δD.

It has been reported that gas production from coalbeds can be thought of as a three-stage process: (1) desorption from the coal matrix; (2) migration through micropores in the coal matrix; and (3) migration through macropores and fractures in the coal matrix towards a production well (Alexeev, A. D., Feldman, E. P. & Vasilenko, T. A. (2007), "Methane desorption from a coal-bed", Fuel 86, 2574-2580). The various isotopic forms of the hydrocarbon components of the natural gas (for example, the isotopic forms of methane) or the isotopic forms of carbon dioxide or the isotopic forms of other gaseous components of natural gas (for example, nitrogen or helium) are liable to be fractionated in the first two steps. Generally speaking, molecules comprising lighter isotopes will desorb faster from the coal matrix than molecules comprising heavier isotopes (where the molecules are different isotopic forms of the same component of the gas). Also, the molecules comprising the heavier isotopes will be slowed down to a greater extent than molecules comprising the lighter isotopes owing to gas chromatographic effects during movement of the gas through the micropores in the coal matrix. The relative importance of these two mechanisms is the subject of debate (Strapoc, D., Schimmelmann, A. & Mastalerz, M. (2006) "Carbon isotopic fractionation of $CH_4$ and $CO_2$ during canister desorption of coal", Organic Geochemistry 37, 152-164). Whatever the exact mechanism, it is known that in processes such as desorption, evaporation, or gas chromatography, the initial gases that are produced from a coal matrix are isotopically light, gradually getting heavier as the desorption process proceeds. A similar fractionation process will occur in "non-coal" tight gas reservoirs, for example, fractionation of the isotopic forms of methane may arise owing to gas chromatographic effects as the gas moves in a tortuous path through the fine pores of the relatively impermeable reservoir rock towards the producing gas well. Thus, the degree of isotopic fractionation of one or more components of the gas produced from a tight gas reservoir or from a coalbed methane reservoir can be used as a progress indicator in processes such as gas recovery.

It has now been found that the degree of isotopic fractionation of one or more components of a produced natural gas can be calibrated in terms of recovery factor for the volume drained by a gas well that penetrates a tight gas reservoir or a coalbed methane reservoir so that the isotopic composition of a component of the produced gas may be used to obtain an estimate of the current recovery factor for a producing gas well.

Thus, the object of the present invention is to obtain an improved estimate of recovery factor that relies on a calibrated relationship between changes in the isotopic composition of one or more components of the produced gas and the recovery factor for the volume drained by the producing gas well. With produced gas volume and recovery factor known, the volume drained by the well can be estimated more accurately, thereby enabling the value of an infill well to be estimated more accurately. It is also envisaged that reservoir simulation techniques may be used to history-match the isotopic data and thereby provide an estimation of shape and size of the drainage volume. A further object of the present invention is to obtain maximum value from each infill well for a tight gas reservoir or a CBM reservoir by optimal placement of each infill well. Yet a further object of the present invention is to maximize the overall value of an infill drilling project by avoiding the wasted expense of drilling wells in locations that have already been drained of gas.

Thus, the present invention relates to a method of estimating the recovery factor for the volume drained by at least one producing gas well that penetrates a tight gas reservoir or a coalbed methane reservoir, the method comprising:

(a) calibrating changes in the isotopic composition of at least one component of the gas that is produced from the gas well with increasing recovery factor;

(b) obtaining a sample of produced gas from the producing gas well and analyzing the sample to obtain the isotopic composition of the component of the produced gas;

(c) using the calibration obtained in step (a) and the isotopic composition determined in step (b) to estimate the recovery factor for the volume drained by the gas well;

(d) using the estimate of the recovery factor determined in step (c) and the cumulative volume of gas produced from the gas well to determine the volume drained by the gas well; and (e) optionally, periodically repeating steps (b) to (d) to determine any increase in recovery factor for the volume drained by the gas well with time and any increase in the volume drained by the gas well with time.

The present invention is applicable to tight gas reservoirs or coalbed methane reservoirs. Preferably, the tight gas reservoir has an effective permeability of less than 0.001 darcies. Suitably, the tight gas reservoir is a gas sand or shale gas reservoir.

Preferably, the method of the present invention is used to estimate the recovery factor for the volume drained by each of a plurality of producing gas wells that penetrate the tight gas reservoir or coalbed methane reservoir. The method of the present invention also allows an estimation of the drainage volume for each of the plurality of producing gas wells. By estimating the drained volume for each existing gas well (and, optionally, by combining this data with geological data for the reservoir), the skilled person can assess whether there are any undrained volumes located between the existing gas wells and the size of such undrained volumes. The skilled person can also determine whether there are any poorly drained volumes (volumes with a low recovery factor). Accordingly, the optimal location for infill wells for accessing such undrained volumes and/or poorly drained volumes can be determined. The skilled person may also decide not to drill an infill well where it is determined that a volume lying between existing gas wells has already been drained by existing gas wells. A further advantage of the method of the present invention is that production of gas from the tight gas reservoir or coalbed methane reservoir can be optimized through a knowledge of changes in the volume drained by each gas well and changes in the recovery factor for the drained volume of each gas well. For example, the efficiency of the existing gas wells that are adjacent an undrained volume (or poorly drained volume) can be assessed. If it is found that at least one of the existing gas wells is producing gas very efficiently (high recovery factor and high cumulative gas production) and it is deduced that this efficient gas well is capable of draining the undrained volume, the production of gas from the efficient gas well may be increased while the production of gas from one or more of the less efficient gas wells may be decreased.

As discussed above, natural gas that is produced from a tight gas reservoir or from a coalbed methane reservoir is a naturally occurring mixture of hydrocarbon gases, usually comprising methane ($CH_4$) as the main constituent, with lesser amounts of ethane ($C_2H_6$), propane ($C_3H_8$), butane ($C_4H_{10}$), pentane ($C_5H_{12}$) and other hydrocarbons. The natural gas may contain, in addition to hydrocarbon gases, other gases including carbon dioxide, nitrogen, hydrogen sulfide and noble gases such as helium, neon and argon. All of these gases can exist in different isotopic forms.

Without wishing to be bound by any theory, it is believed that the different isotopic forms of the gaseous components of the natural gas fractionate during gas production from a tight gas reservoir or coalbed methane reservoir such that increasing amounts of the heavier isotopic forms are produced with increasing recovery factor. Thus, the isotopic compositions of the hydrocarbon components of the produced gas ($\delta^{13}C$ and/or $\delta D$) have been found to change systematically with increasing recovery factor. Similarly, the isotopic compositions of the non-hydrocarbon components of the produced gas (for example, carbon dioxide $\delta^{13}C$, nitrogen $\delta^{15}N$, or helium $\delta^{3}He$) will change systematically with increasing recovery factor.

It is known that the concentrations of the molecular components of the gas produced from a gas well that penetrates a tight gas reservoir or a coalbed methane reservoir also change systematically with increasing recovery factor. Thus, increasing amounts of higher molecular weight components are produced with increasing recovery factor. The present invention therefore contemplates determining changes in the concentrations of the various molecular components of the produced gas over time and also changes in the concentration ratios of such molecular components over time (for example, increases in the $CO_2$ to $CH_4$ ratio over time). Accordingly, data relating to changes in the molecular composition of one or more components of the produced gas could be combined with the data relating to changes in the different isotopic forms of one or more components of the produced gas to provide additional information or increased precision when predicting the recovery factor.

The calibration of step (a) may be determined empirically, for example, by fitting a curve or straight line to a plot of changes in the isotopic composition of at least one component of the produced gas against increasing recovery factor. In particular, a curve or straight line could be fitted to a plot of δ13 or δD for a hydrocarbon component of the produced gas, for example, methane. However, it is also envisaged that one or more modeling approaches may be used to calibrate changes in the isotopic composition of a component of the produced gas with increasing recovery factor. An advantage of a modeling approach is that this allows the skilled person to determine the theoretical shape of the curve (or straight line) that is to be fitted to the experimental data. This is important where there is scatter in the experimental data such that more than one curve (and/or straight line) could be fitted to the experimental data.

It has now been found that the fractionation of gas isotopic compositions may be modeled as a Rayleigh distillation process (see Rayleigh J. W. S. (1896), "Theoretical considerations respecting the separation of gases by diffusion and similar processes", Philos. Mag. 42, 493-593; Ray, and J. S. & Ramesh, R (2000), "Rayleigh fractionation of stable isotopes from a multicomponent source", Geochimica et Cosmochimica Acta 64, 299-306). Thus, the fractionation of gas isotopic compositions may be modeled as a Rayleigh distillation process using the following equation:

$$\delta i-\delta r=1000(\alpha-1)\ln f \quad \text{(Equation 1)}$$

where δi is the initial isotopic composition of a gas component, δr is the isotopic composition of the gas component for the remaining gas at the time when proportion f of the initial amount remains (i.e. when 1−f has been removed), and α is the isotopic fractionation factor for the gas component. This formula establishes a relationship between recovery factor (1−f) and the composition of the remaining gas (δr). Using a material balance equation (recognizing that the remaining gas plus the produced gas=the initial gas), it is possible to obtain a relationship between recovery factor (1-f) and composition of the gas produced (δp):

$$\delta p=(\delta i-f\delta r)/(1-f) \quad \text{(Equation 2)}$$

However, the person skilled in the art will understand that other approaches may be used when modeling the fractionation of gas isotopic compositions and the present invention should not be interpreted as being limited to the use of the above Rayleigh distillation model.

A Rayleigh distillation model may be derived using fractionation data obtained for molecules having different carbon isotopes ($^{12}C$ and $^{13}C$) and/or for fractionation data obtained for molecules having different hydrogen isotopes ($^{1}H$ and $^{2}H$ (D)) and/or for fractionation data obtained for the different isotopic forms of nitrogen, helium, neon or argon. For example, there will be variations seen in the carbon and hydrogen isotopic composition of methane, the carbon and hydrogen isotopic composition of other hydrocarbon components of the natural gas (such as ethane, propane, butane and pentane), and the carbon isotopic composition of carbon dioxide, with increasing gas production. The variations seen for the hydrogen isotopic composition of methane may be greater or less than the variations seen for the carbon isotopic composition of methane depending on the values of the carbon and hydrogen isotopic fractionation factors (α). If the methane molecules containing different hydrogen isotopes fractionate differently to methane molecules containing different carbon isotopes, then the combination of carbon isotope analysis and hydrogen isotope analysis of produced methane may give additional information or provide greater precision to the estimation of recovery factor.

The main unknown for the Rayleigh distillation model is the fractionation factor α, which may be derived empirically using Equation 1 above. However, if the value of α is already known for a similar type of tight gas reservoir or coalbed methane reservoir, there may be no requirement to determine a value of α for the reservoir under consideration. Alternatively, an isotopic fractionation factor, α, that has been determined experimentally for an analogue system may be applied to the reservoir under consideration. One suitable analogue is the fractionation of carbon isotopes of methane during the generation of gas by the thermal maturation of coal (Whiticar, M. J. (1996), "Stable isotope geochemistry of coals, humic kerogens and related natural gases", International Journal of Coal Geology 32, 191-215; and Berner, U., Faber, E. & Stahl, W (1992), "Mathematical simulation of the carbon isotopic fractionation between huminitic coals and related methane Chemical Geology", Isotope Geoscience, Section 94, 315-319). In this analogue, the isotopic fractionation factor, α, for the carbon isotopes of methane was determined experimentally as 1.003.

Calibration step (a) may be achieved using canister desorption experiments performed on a sample of reservoir rock (or a sample of coal from a coalbed methane reservoir) to determine changes in the isotopic composition ($\delta^{13}C$ and/or $\delta D$) of one or more hydrocarbon components of the gas that is progressively desorbed from the reservoir rock (or coal) sample. Typically, a sample of the reservoir rock is obtained by taking a core sample (the well is cored or sidewall cored) at reservoir pressure and before any gas has been produced from the well. The core sample is then placed in a canister and is shipped immediately to a laboratory for isotopic analysis of the gas contained in the core sample. However, it is also envisaged that the canister desorption experiment may be performed in a laboratory at the production site. The changes in isotopic composition of one or more components of the gas with increasing gas desorption from the sample may be determined using online analysis. Changes in the molecular composition of one or more components of the gas may also be determined using online analysis. Typically, online gas analysis is performed for methane content, methane $\delta^{13}C$, methane $\delta D$, $CO_2$ content and $CO_2$ $\delta^{13}C$. The isotopic composition data may then be correlated or calibrated with the gas recovery factor using the simple theoretical model described above. Optionally, the molecular composition data (for example, $CO_2$:$CH_4$ ratio) may also be correlated, or calibrated with the gas recovery factor.

Alternatively, calibration step (a) may be achieved by determining changes in the gas isotopic composition of at least one component of the gas obtained from a producing well over a period of time. Thus, the cumulative produced volume for the producing gas well is monitored and gas samples are taken at regular intervals. For example, changes in the methane $\delta^{13}C$ and/or methane $\delta D$ may be determined over a period of time and the initial methane $\delta^{13}C$ and/or methane $\delta D$ may then be obtained by extrapolating a plot of produced gas methane $\delta^{13}C$ or methane $\delta D$ against recovery factor to zero recovery factor thereby providing an estimate of the methane $\delta^{13}C$ and/or methane $\delta D$ at zero recovery factor (i.e. an estimate of $\delta i$, before any gas was produced from the reservoir). Accordingly, the calibration using canister desorption experiments may be unnecessary.

Following the calibration step (a), a gas sample may be taken from one or more producing gas wells and the sample may be analyzed to determine the isotopic composition of at least one component of the gas sample, for example, the $\delta^{13}C$ and/or $\delta D$ for methane. Typically, a low pressure gas sample is taken at or near the wellhead using a suitable capture vessel which is then shipped to a laboratory for gas isotopic analysis. Alternatively, the isotopic analysis of the gas sample may be performed at the production site. The isotopic composition of at least one component of the gas sample, for example, methane, in then used to estimate the recovery factor for the producing gas well using the calibration obtained in step (a). When the recovery factor is combined with the cumulative produced gas volume, this allows an estimation of drainage volume for the producing gas well. The estimation of the drained volume for one or more, preferably, all of the existing producing gas wells, will allow an estimation of the extent to which volumes between the producing gas wells have been drained, for example, there may be undrained volumes or poorly drained volumes. This, in turn, allows an assessment of the value of a potential infill well location, especially where the proposed infill well location is close to an existing gas well. When the drained volume is combined with geological information relating to reservoir thickness, this allows an estimation of drainage area. The shape of the drained area may be predicted by combining the estimation of drainage area with additional geological reservoir information such as permeability of the reservoir rock in different directions. Thus, combining the estimate of drainage volume with geological information to predict the drainage area and, optionally, the shape of the drainage area, for one or more of the existing gas wells, allows a more accurate assessment of the value of a potential infill well.

An advantage of the present invention is that it allows improved reservoir management of tight gas reservoirs or of coalbed methane reservoirs, in particular, an improved ability to determine the optimal location and spacing of infill gas production wells thereby improving the recovery of gas from the tight gas reservoir or the coalbed methane reservoir. The person skilled in the art would understand that there is a high cost associated with the drilling of infill wells, generally, at progressively closer well spacings over time, for tight gas reservoirs and for coalbed methane reservoirs. By optimizing the location and spacing of such infill wells or by taking a decision not to drill an infill well, the number of such wells may be reduced. This would result in considerable savings in otherwise wasted drilling costs.

It is known that gas isotopic composition can vary spatially within tight gas fields or within coalbed methane fields. If the variation in gas isotopic composition within the tight gas field or coalbed methane field is minimal, the method of the present invention would require only a single calibration. Thus, core from the tight gas field or from the coalbed methane field may be taken at a single location (by drilling an exploratory well or by taking sidewall core from an existing well and then performing a canister desorption experiment with online isotopic analysis of the desorbed gas with time). However, if gas isotopic composition varies spatially, then the field may be mapped to determine the gas isotopic composition for groups of producing wells. Accordingly, calibration is required for each group of producing wells. Where the gas isotopic composition varies from well to well, calibration would be required for each individual well. However, as discussed above, the need for laboratory calibration could be avoided altogether by obtaining a time series of gas analyses from a producing gas well. This would create a dataset, where the initial isotopic composition of a component of the produced gas, in particular, methane could be determined by curve fitting rather than by direct measurement.

It is also known that the proportion of gas recovered from the drained volume (or area) of a gas well of a tight gas reservoir or CBM reservoir will vary with distance from the well. Volumes (or areas) close to the well will have yielded a much greater proportion of their initial gas-in-place than those distant volumes (or areas) that are close to the pressure transient front. Accordingly, the reservoir pressure increases with increasing distance from a producing gas well until the pressure reaches the initial reservoir pressure. It is also known that where two gas wells have similar drainage volumes, and similar recovery factors, the changes in pressure with distance from the producing well (often referred to as "sweep efficiency") may be very different. For example, gas may have been relatively evenly recovered from the drainage volume or there could have been significantly less gas recovered from the edges of the drainage volume. Typically, pressure isobars (contour lines of equal pressure) may be mapped for the drained volume (or area) of a producing gas well thereby providing a visualization of changes in the reservoir pressure over the drainage volume (or area). It is also known that where a gas well is producing from more than one tight gas reservoir or from more than one coal seam (located at different depths), recoveries may be different in each reservoir or coal seam. The isotopic composition of the produced gas provides an overall volumetric average recovery factor from the total accessed volume (drained volume) of the gas well. However, it is envisaged that the present invention may be used in combination with advanced reservoir description and modeling techniques to deduce the spatial distribution of gas recovery around a producing gas well including from different reservoirs or coal seams. This may be achieved by either combining different measurements (for example, $\delta^{13}C$ or $\delta D$ for methane, $\delta^{13}C$ for carbon dioxide, or aspects of gas molecular composition) or by repeated measurements of such parameters over time thereby creating an overall response curve that may be simulated and matched to various possible scenarios. For example, it is believed that the shape of the curve of the gas isotopic composition of at least one component of the produced gas (for example, methane $\delta^{13}C$ or methane $\delta D$) over time (i.e. with increasing recovery) may be used to predict changes in the sweep efficiency for the drained volume (or area) of a producing gas well.

The performance information to be obtained using the method of the present invention includes, but is not limited to, recovery factor, drainage and sweep efficiencies, drainage volume, drainage area and shape of the drained area for each gas well, and the spatial distribution of the drained reservoir volume.

BRIEF DESCRIPTION OF THE DRAWINGS

The present invention will now be illustrated by reference to the following Examples and Figures in which:

FIG. 1 shows a plot of methane $\delta^{13}C$ for the produced gas ($\delta p$) versus recovery factor obtained using equations 1 and 2 of the Rayleigh Distillation model of the present invention, for an $\alpha$ value of 1.003 and an initial $\delta^{13}C$ of −54.8‰. Given that $\delta^{13}C$ can be routinely measured to an accuracy of approximately 0.1‰, this plot shows that isotopic gas composition is a sensitive indicator of recovery factor.

EXAMPLE 1

Gas production from Illinois Basin coals has previously been studied using gas desorption experiments as described by Strapoc, D., Schimmelmann, A. & Mastalerz, M. (2006) "Carbon isotopic fractionation of $CH_4$ and $CO_2$ during canister desorption of coal", Organic Geochemistry 37, 152-164.

Strapoc et al modified a canister desorption rig (equipment routinely used to measure the amount of gas contained in coal, where a coal sample is placed in a sealed canister and allowed to evolve gas over a period of weeks to months) to allow sampling for gas isotopic composition analysis. The gas samples were analyzed for methane $\delta^{13}C$, and it was found that the methane became isotopically heavier with progressive gas production. Table 1 below shows data reported by Strapoc et al for off-line isotopic analyses of gas desorbed from coal core V-3/1

TABLE 1

| Day of desorption | Fraction of gas desorbed up to date of sampling | $\delta^{13}C$ $CH_4$ (‰) |
|---|---|---|
| 1 | 0.14 | −57.42 |
| 2 | 0.25 | −57.60 |
| 3 | 0.31 | −57.05 |
| 5 | 0.37 | −57.03 |
| 7 | 0.47 | −56.70 |
| 8 | 0.51 | −56.23 |
| 15 | 0.59 | −56.56 |
| 36 | 0.77 | −56.64 |
| 50 | 0.84 | −56.06 |
| 64 | 0.89 | −55.68 |

Figure 1:
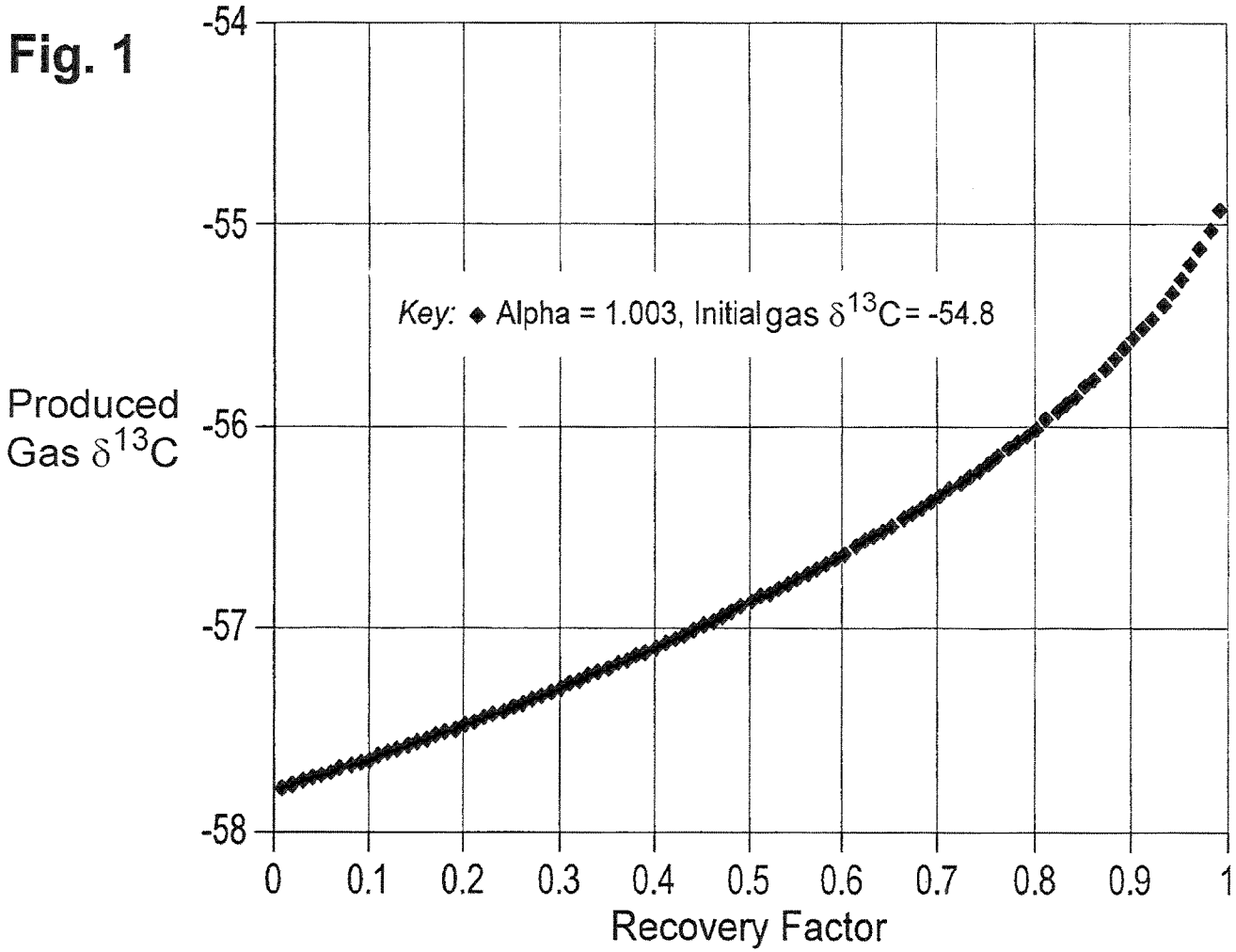
FIG. 1 shows a plot of methane $\delta^{13}C$ for the produced gas ($\delta p$) versus recovery factor obtained using equations 1 and 2 of the Rayleigh Distillation model of the present invention, for an $\alpha$ value of 1.003 and an initial $\delta^{13}C$ of −54.8%
Figure 2:
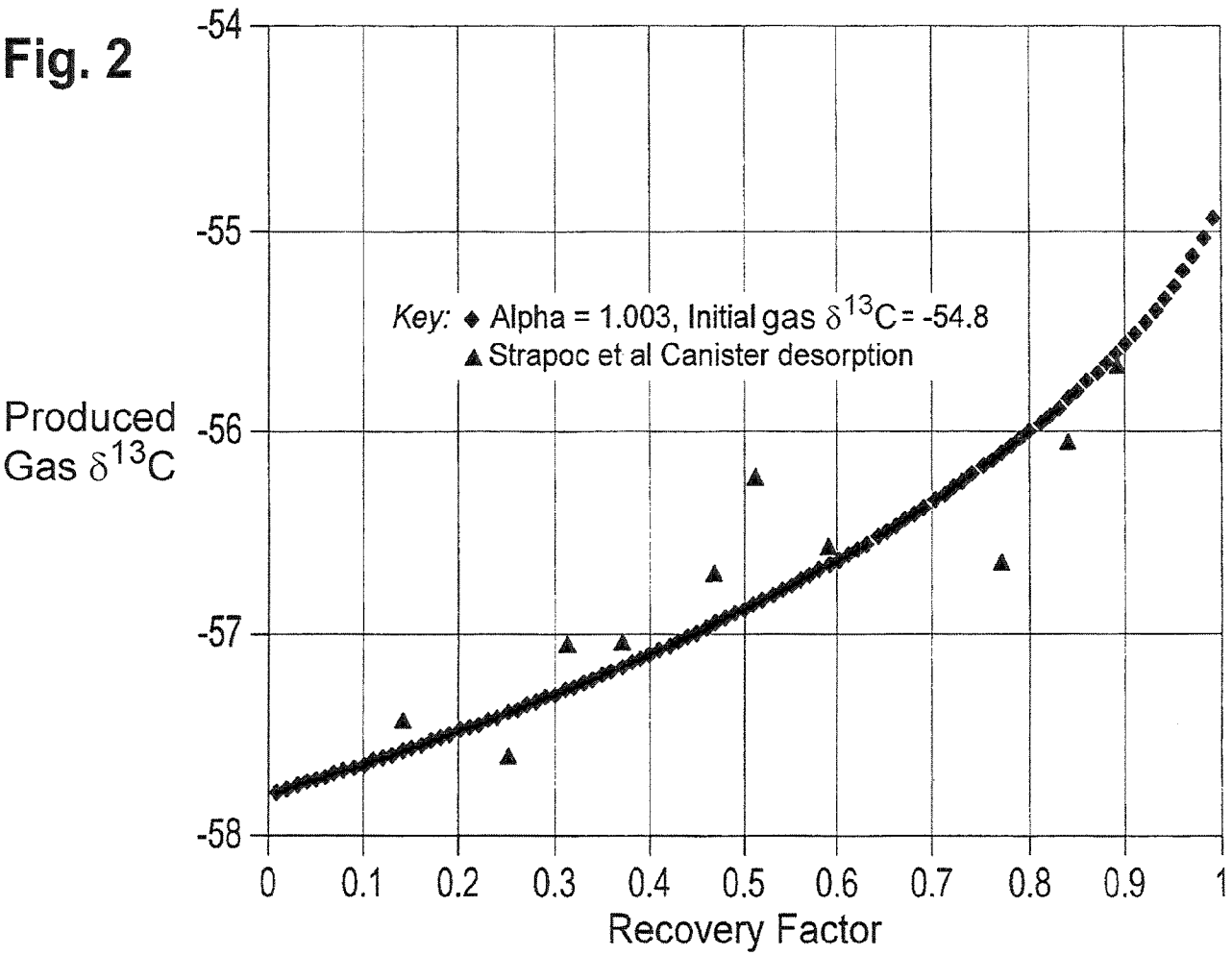
FIG. 2 shows the data of Table 1 superimposed on the curve of FIG. 1.

This data is also shown in FIG. 2, superimposed on the curve of FIG. 1 which was modeled using the Rayleigh Distillation model of the present invention. The experimental data of Strapoc et al fit very well to the modeled curve when using an appropriate Illinois Basin initial methane $\delta^{13}C$ value of −54.8‰ and the published $\alpha$ value of 1.003. This Example shows that the data of Strapoc et al can be modeled as a Rayleigh Distillation process thereby allowing quantitative predictions of recovery factor for the volume drained by a gas well to be made.

EXAMPLE 2

Table 2 below shows further data reported by Strapoc et al for on-line isotopic analyses of gas desorbed from coal core V-3/1 and for off-line isotopic analyses of gas desorbed from coal core II-3/2

TABLE 2

| Sample | Day of desorption | Fraction of gas desorbed up to date of sampling | $\delta^{13}C$ $CH_4$ (‰) |
|---|---|---|---|
| V-3/1 (on-line) | 1 | 0.14 | −57.60 |
| | 5 | 0.37 | −57.38 |
| | 15 | 0.59 | −56.94 |
| | 36 | 0.77 | −56.55 |
| | 50 | 0.84 | −56.35 |
| II-3/2 (off-line) | 5 | 0.40 | −56.86 |
| | 57 | 0.89 | −56.02 |
| | 95 | 0.98 | −55.55 |

Figure 3:
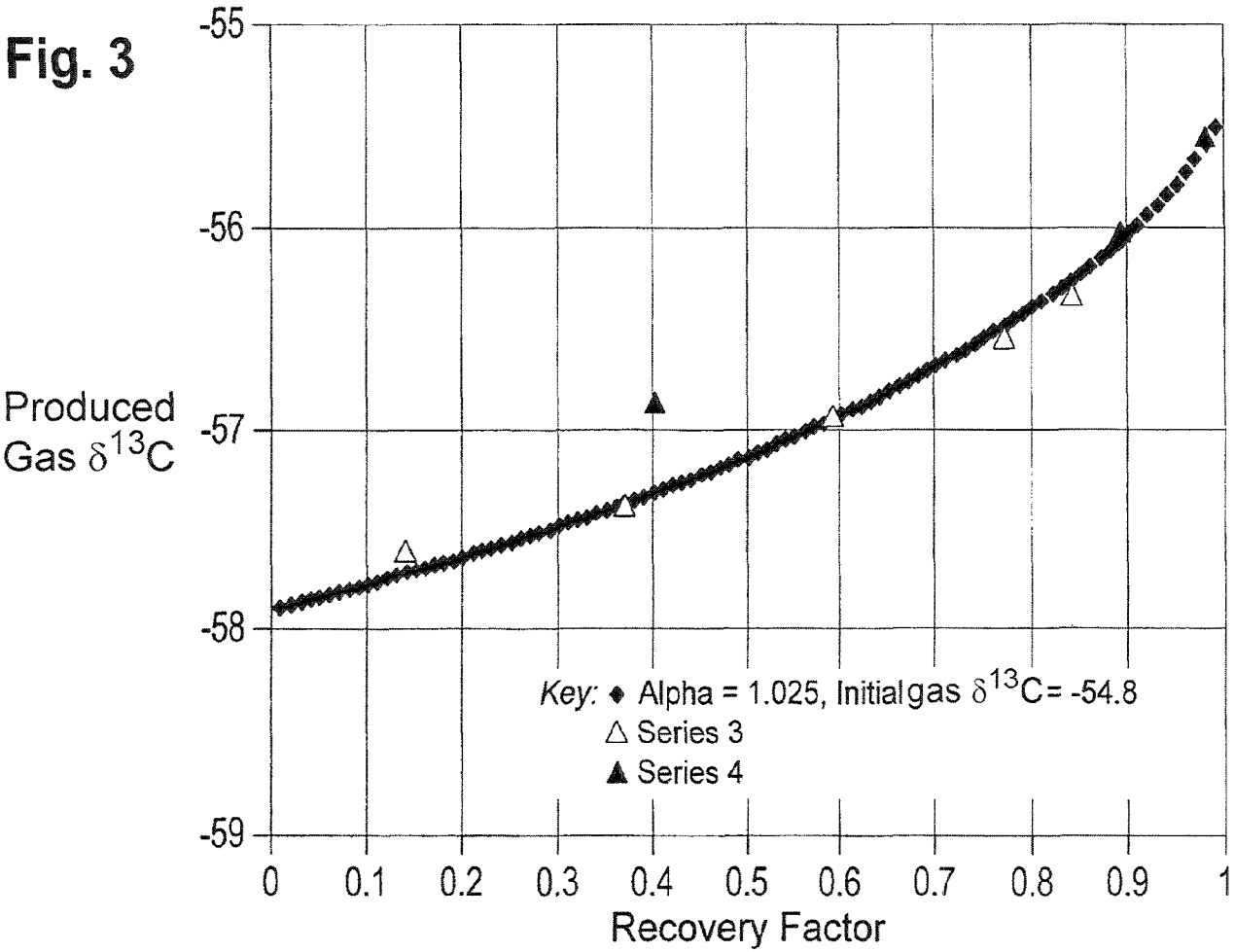
FIG. 3 shows the data Table 2 fitted to a modeled curve obtained by using an initial $\delta^{13}C$ value of −55.4% and an $\alpha$ value of 1.0025 in the Rayleigh Distillation model of the present invention.

This data is also shown in FIG. 3 fitted to a modeled curve obtained by using an initial $\delta^{13}C$ value of −55.4‰ and an $\alpha$ value of 1.0025 in the Rayleigh Distillation model of the present invention.

It was found that the published experimental data of Strapoc et al gave support for the Rayleigh distillation model of the present invention and an empirical $\alpha$ value of about 1.003. It was also found that the model curves derived from the Rayleigh distillation model of the present invention could be used to predict recovery factor from methane $\delta^{13}C$ of produced gas.

The invention claimed is:

1. A method of estimating the recovery factor for the volume drained by at least one producing gas well that penetrates a tight gas reservoir or a coalbed methane reservoir, the method comprising:

(a) calibrating changes in the isotopic composition of at least one component of the gas that is produced from the gas well with increasing recovery factor;

(b) obtaining a sample of produced gas from the producing gas well and analyzing the sample to obtain the isotopic composition of the component of the produced gas;

(c) using the calibration obtained in step (a) and the isotopic composition determined in step (b) to estimate the recovery factor for the volume drained by the gas well; and (d) using the estimate of the recovery factor determined in step (c) and the cumulative volume of gas produced from the gas well to determine the volume drained by the gas well.

2. A method as claimed in claim 1 wherein steps (b) to (d) are periodically repeated to determine any increase in recovery factor for the volume drained by the gas well with time and any increase in the volume drained by the gas well with time.

3. A method as claimed in claim 1 wherein the tight gas reservoir has an effective permeability of less than 0.001 darcies.

4. A method as claimed in claim 1 wherein the gas that is produced from the gas well(s) comprises methane.

5. A method as claimed in claim 1 wherein the calibration is achieved by: obtaining a sample of reservoir rock or coal under reservoir conditions and before gas has been produced from the reservoir; subjecting the sample of rock or coal to gas desorption and determining changes in the isotopic composition of one of more components of the desorbed gas with progressive gas desorption from the sample; and, calibrating the changes in the isotopic composition of the one or more components of the desorbed gas with gas recovery factor using a Rayleigh Distillation model.

6. A method as claimed in claim 1 wherein the calibration is achieved by: determining the isotopic composition of at least one component of the gas produced from the gas well over a period of time; extrapolating a plot of the isotopic composition for the component of the produced gas against recovery factor for the drained volume of the gas well to zero recovery factor thereby providing an estimate of the isotopic composition of the component of the produced gas at zero recovery; and calibrating the changes in isotopic composition of the component of the produced gas with gas recovery factor using a Rayleigh Distillation model.

7. A method as claimed in claim 1 wherein step (a) comprises calibrating changes in the $\delta^{13}C$ and/or $\delta D$ of methane with increasing recovery from the reservoir.

8. A method as claimed in claim 1 wherein changes in the molecular composition of two or more components of the gas produced from the gas well are determined over a period of time and changes in the concentration ratio(s) of the two or more components with time are used to provide additional information concerning the estimate of recovery factor for the volume drained by the gas well or to increase the precision of the estimate of the recovery factor for the volume drained by the gas well.)

9. A method as claimed in claim 1 wherein the reservoir is penetrated by a plurality of existing gas wells, and wherein the estimate of the recovery factor for the volume drained by each existing gas well and the estimate of the volume drained by each existing gas well are used to determine the spatial distribution of the drained reservoir volume and/or any variations in recovery factor over the drained reservoir volume thereby identifying undrained and/or poorly drained volumes of the reservoir.

10. A method as claimed in claim 9 wherein the location for an infill well is selected such that the infill well penetrates an undrained or poorly drained volume of the reservoir.

* * * * *